United States Patent [19]

Bradshaw

[11] 4,440,410

[45] Apr. 3, 1984

[54] HOPPER FOR CONTAINING DRYWALL JOINT COMPOUND

[76] Inventor: Larry R. Bradshaw, 1703 Shely St., Longview, Tex. 75604

[21] Appl. No.: 325,749

[22] Filed: Nov. 30, 1981

[51] Int. Cl.[3] ..... B62B 1/10; B67D 5/50

[52] U.S. Cl. ..... 280/47.26; 141/231; 220/344; 222/385; 222/608; 280/79.2; D34/25

[58] Field of Search ..... 222/628, 610, 608, 609, 222/383, 385; 280/47.24, 47.26, 47.13 R, 47.17, 47.31, 47.34, 79.2; D34/24, 25, 26; 220/1 T, 20.5, 1 M, DIG. 6, 344; 141/231

[56] References Cited

U.S. PATENT DOCUMENTS

| | | | |
|---|---|---|---|
| 2,203,242 | 6/1940 | Weber | 222/383 |
| 2,545,319 | 3/1951 | Sundholm | 222/383 |
| 3,199,744 | 8/1965 | Greenburg | 222/383 |
| 3,372,995 | 3/1968 | Ryan | 222/608 |
| 3,814,149 | 6/1974 | Dunavant | 141/231 |
| 4,361,252 | 11/1982 | Black | 220/344 |

FOREIGN PATENT DOCUMENTS

| | | | |
|---|---|---|---|
| 202417 | 6/1956 | Australia | 222/385 |

*Primary Examiner*—David M. Mitchell
*Assistant Examiner*—Timothy Roesch
*Attorney, Agent, or Firm*—John M. Harrison

[57] ABSTRACT

A hopper or container for containing drywall joint compound or "mud" used in the "taping and floating" of seams between drywall panels, which hopper includes a shaped metal tank which tapers to define a closed funnel at the bottom, and a pump support projecting from the tank near the bottom, with a pump access opening in the pump support to receive a filler pump for pumping the joint compound from the tank on demand. The hopper can be fitted with wheels to better facilitate mobility, and is provided with a hinged lid fitted with a gasket, for loading the joint compound into the tank and maintaining a tight seal between the closed lid and the top of the hopper.

7 Claims, 10 Drawing Figures

FIG. 1
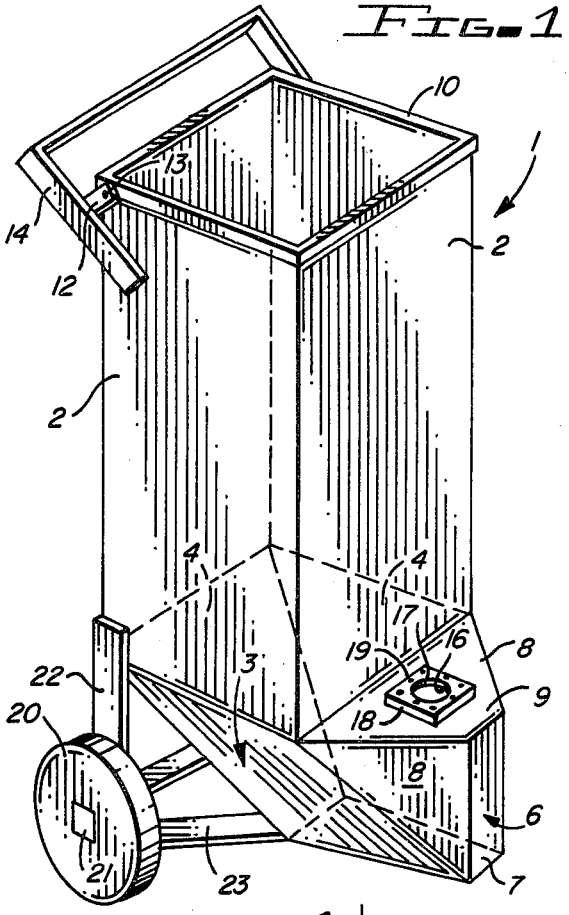
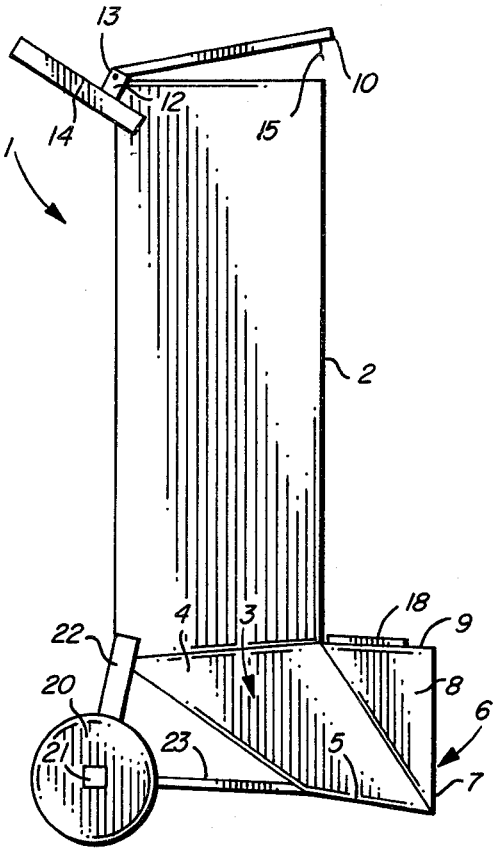
FIG. 2
FIG. 3
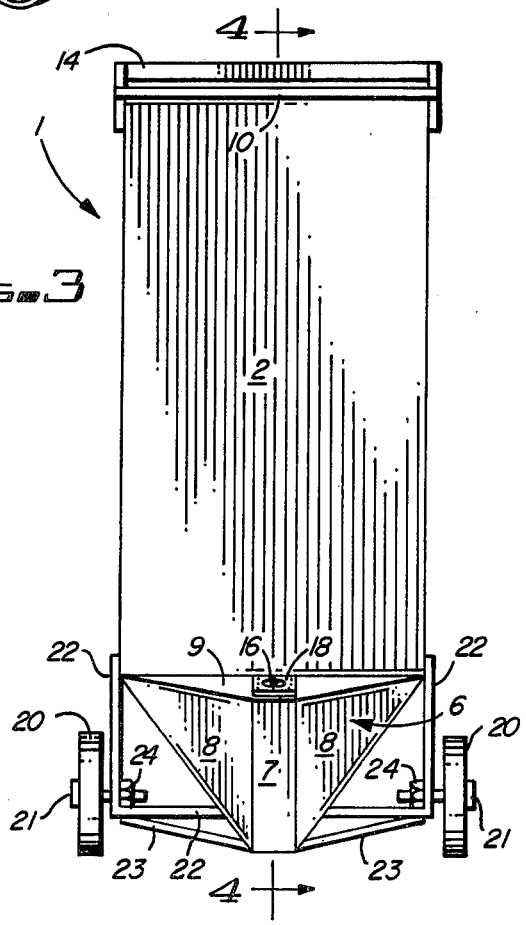
FIG. 4
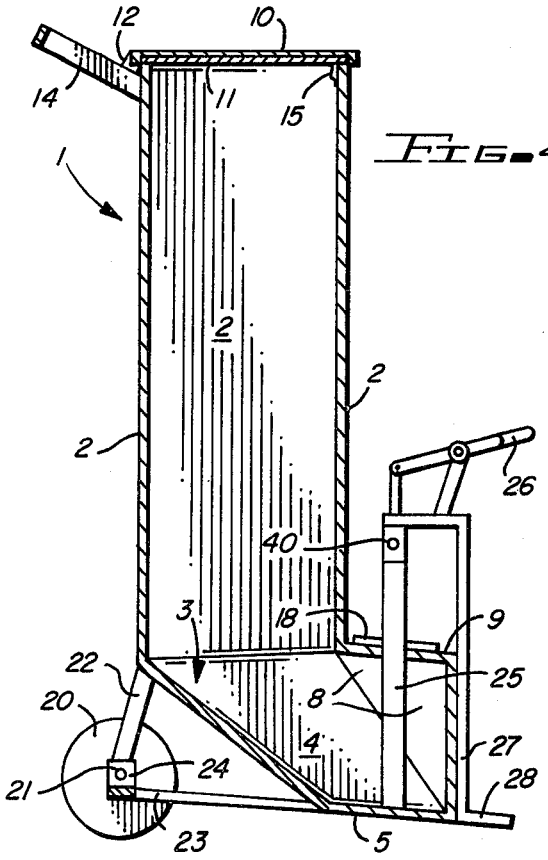

HOPPER FOR CONTAINING DRYWALL JOINT COMPOUND

BACKGROUND OF THE INVENTION

1. Field of the Invention

This invention relates to the "taping and floating," or sealing of seams between drywall or gypsum board panels in the construction industry. More particularly, the invention relates to a hopper for containing joint compound or drywall "mud" for use by drywall installers on construction jobs which require large quantities of the joint compound.

The sealing or "floating" of seams between drywall panels requires the use of wet joint compound and paper tape, the latter of which is placed over the seam and "floated" in place by application of the joint compound. The joint compound is typically mixed in small quantities by combining a powdered drywall material with water until a desired consistency is achieved. On relatively large jobs a considerable amount of time is wasted in this mixing process, since large quantities of joint compound of proper "floating" consistency are required in order to speed up the work and promote efficiency in the taping and floating operation.

2. Description of the Prior Art

Preparation of joint compound having a desired consistency in taping and floating drywall joints is usually accomplished by mixing relatively small quantities of powdered drywall compound mix with water to effect a joint compound or "mud" of proper consistency for application to walls and ceilings. Since the compound dries rapidly, small quantities are usually mixed and are the then rapidly applied to prevent hardening prior to use. On large jobs, the need for larger quantities of joint compound is apparent, and a considerable amount of time and efficiency is lost in each batch mixing operation. Efforts to increase the efficiency of drywall taping and floating operations include the use of open buckets containing the joint compound, and hand pumps inserted in the buckets to facilitate a supply of smaller quantities of compound to each user. However, since the compound in the buckets is exposed to air, it dries quickly, and is rapidly rendered useless to the workmen.

Accordingly, there is a need in the art for, and it is an object of this invention to provide, a hopper or container means for supplying large quantities of wet drywall joint compound of selected consistency upon demand to the job site.

Another object of the invention is to provide a hopper or container for containing a selected quantity of premixed drywall joint compound of desired consistency to the job site for dispensing to construction workers as needed, which hopper is highly mobile, and is designed to retard drying of the joint compound for a considerable period of time.

Yet another object of the invention is to provide a joint compound container or hopper which is shaped to contain a selected quantity of premixed drywall joint compound or "mud," and is designed to receive a pump and to cause the joint compound to "channel," or flow to the pump intake, for removing a selected quantity of the joint compound on demand as needed.

A still further object of this invention is to provide a hopper for containing a supply of drywall joint compound, which hopper is characterized by a supply tank; a generally funnel-shaped, closed bottom segment attached to the supply tank; a pump support projecting outwardly from the bottom segment; and a pump access aperture in the pump support to facilitate insertion of a pump into the bottom segment of the hopper to pump the joint compound from the hopper.

Yet another object of this invention is to provide a mobile hopper or container for containing a supply of wet drywall joint compound and keeping the compound fresh and at a proper consistency, which hopper includes a storage tank of generally round, or polygonal, and most preferably, square or rectangular construction and a closed, generally funnel-shaped bottom provided with an outwardly-extending pump support having a deck further provided with an access aperture for receiving a joint compound pump, and wheels and a handle mounted on the tank for ease in moving the hopper from one location to another on the job site.

SUMMARY OF THE INVENTION

These and other objects of the invention are provided in a hopper for containing a supply of drywall joint compound, which hopper includes a shaped supply tank; a lid and gasket combination for introducing the premixed joint compound into the tank, sealing the tank and maintaining the compound mix at a desired consistency; a generally funnel-shaped bottom segment attached to the supply tank, and shaped to cause the joint compound to flow into a pump support chamber, shaped by a pump support projecting from the bottom segment and extending from the supply tank; and a pump access aperture in the pump support deck of the pump support to facilitate insertion of a pump into the pump support chamber and pumping the joint compound from the bottom segment of the hopper on demand. In a preferred embodiment of the invention the hopper supply tank is essentially square in cross-section, and the hopper is provided with wheels and a handle for convenience in moving from one location to another, particularly when the hopper is filled with mixed drywall joint compound.

BRIEF DESCRIPTION OF THE DRAWINGS

The invention will be better understood by reference to the accompanying drawings, wherein:

FIG. 1 is a perspective view of a preferred embodiment of the hopper of this invention, with the non-visible interior structural features of the hopper outlined in phantom for clarity;

FIG. 2 is a side elevation of the hopper illustrated in FIG. 1, with the lid partially raised;

FIG. 3 is a front elevation of the hopper illustrated in FIG. 1;

FIG. 4 is a sectional view of the hopper, taken along lines 4—4 in FIG. 3;

DESCRIPTION OF THE PREFERRED EMBODIMENT

Figure 5:
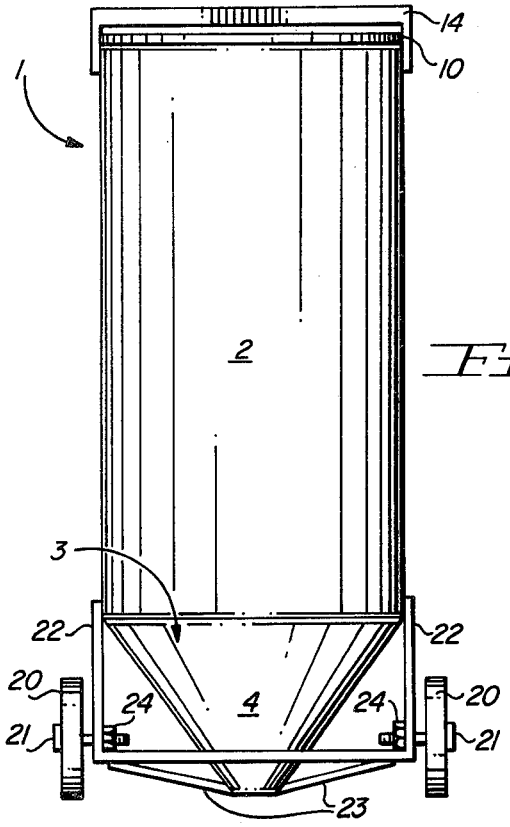
FIG. 5 is a rear elevation of the hopper illustrated in FIGS. 1–4.
Figure 6:
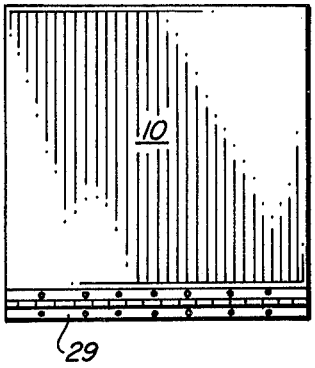
FIG. 6 is a top elevation of a hopper lid with an alternative hinge arrangement.
Figure 8:
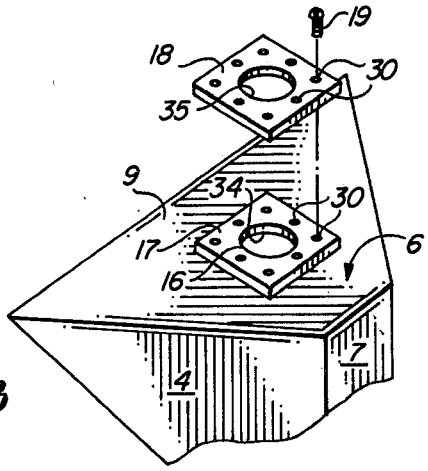
FIG. 8 is an exploded view, partially in section, of a preferred pump support, pump access aperture, pump access gasket and gasket retainer.

Referring now to FIGS. 1, 3 and 5 of the drawings, in a most preferred embodiment, the hopper of this invention is generally illustrated by reference numeral 1, and is characterized by a generally square or rectangular-shaped tank, defined by hopper sides 2. A hopper lid 10 is hinged to the top of hopper 1 by means of hinge mounts 12, carried by handle 14, and by a cooperating hinge pin 13, which is attached to hopper lid 10 and projects through hinge mounts 12. Alternatively, and in a most preferred embodiment of the invention hopper lid 10 can be attached to hopper 1 by means of a piano hinge 29, as illustrated in FIG. 6. In another most preferred embodiment of the invention handle 14 is secured to hopper sides 2 by welding, although it will be recognized by those skilled in the art that alternative means of attachment can be used, as desired. The bottom portion of hopper 1 is shaped to form a hopper funnel 3, with the three funnel sides 4 sloping from attachment to three of the sides 2 to define a funnel bottom 5. The fourth and front side of the tank funnel 3 is closed by a pump support 6, which projects from the fourth and front one of hopper sides 2, and is characterized by a pair of pump support sides 8, which extend from a pump support front 7 to join the side ones of funnel sides 4. A slightly downwardly extending pump support deck 9 extends from the front one of hopper sides 2 to the pump support front 7. In a most preferred embodiment of the invention the pump support deck 9 slopes about 2 degrees from the horizontal, in order to accommodate a conventional pump, as hereinafter described. A deck aperture 34 is provided in pump support deck 9 for insertion of a conventional pump 25 into the interior of the tank funnel 3, as illustrated in FIG. 4. The slope of pump support deck 9 permits easy insertion of pump 25 in the pump access aperture 16, and allows the top of pump 25 to easily clear the front one of hopper sides 2. In a most preferred embodiment of the invention the deck aperture 34 is about $2\frac{7}{8}$ inches in diameter, and a gasket retainer 18, having a retainer aperture 35 of essentially the same size as the deck aperture 34, is secured to pump support deck 9 by gasket retainer screws 19, which register with retainer screw apertures 30 in gasket retainer 18, as illustrated in FIG. 8. A pump access gasket 17, also provided with retainer screw apertures 30, and having a pump access aperture 16, is sandwiched between the gasket retainer 18 and the pump support deck 9. Pump access aperture 16 is smaller than deck aperture 34 and retainer aperture 35, and when pump access gasket 17 is in position, a rubber collar of about $\frac{1}{4}$ of an inch in length serves to seal the conventional pump 25 when it is inserted into the hopper funnel 3, as illustrated in FIG. 4.

Figure 7:
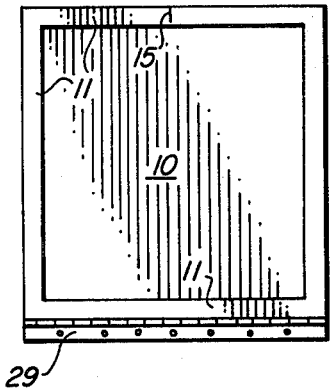
FIG. 7 is a bottom elevation of the hopper lid illustrated on FIG. 6, more particularly illustrating a preferred gasket configuration.

Referring now to FIGS. 2–4 and 7 of the drawings, and particularly to FIGS. 4 and 7, in yet another most preferred embodiment of the invention the hopper lid 10 is fitted with a lid gasket 11 and a lid retainer 15 in order to seal the top of hopper 1 and help to prevent premature drying of the joint cement in hopper 1. Furthermore, as heretofore described, the hopper lid 10 can be attached to the hopper 1 by means of hinge mounts 12, projecting from handle 14, and a cooperating hinge pin 13, which extends through hopper lid 10 and into hinge mounts 12. However, a most preferred attachment is by means of the piano hinge illustrated in FIGS. 6 and 7. As further illustrated in FIGS. 2 and 4, in still another most preferred embodiment of the invention the hopper 1 is provided with wheels 20, which are rotatably mounted on a common wheel strut 22, which extends downwardly from welded attachments to the hopper sides 2 of hopper 1, and is disposed beneath and rearwardly of the hopper funnel 3. The wheel strut 22 is maintained in this position by wheel braces 23, and wheels 20 are secured on hopper 1 by means of shoulder bolts 21, threadably cooperating with nuts 24, which are welded to wheel strut 22, as particularly illustrated in FIGS. 3 and 4, to facilitate movement of the hopper 1 and contents to any desired location on the job.

Figure 9:
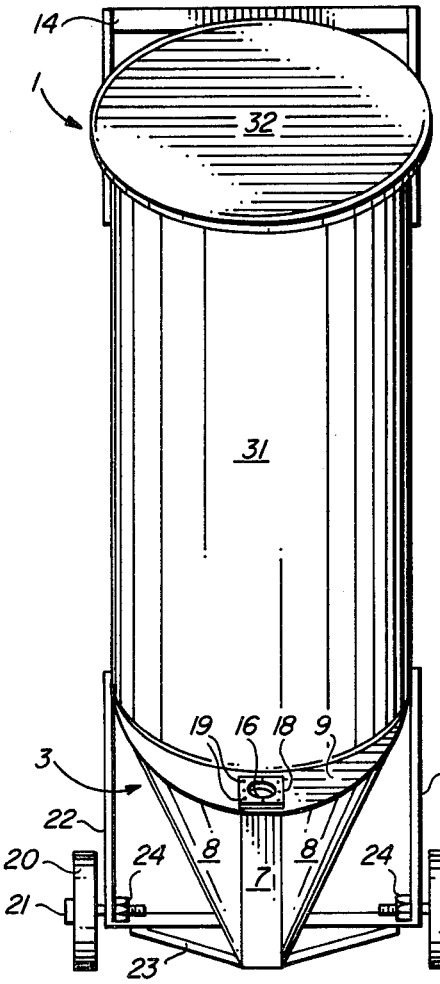
FIG. 9 is a perspective view of the hopper of this invention with an optional cylindrical tank.
Figure 10:
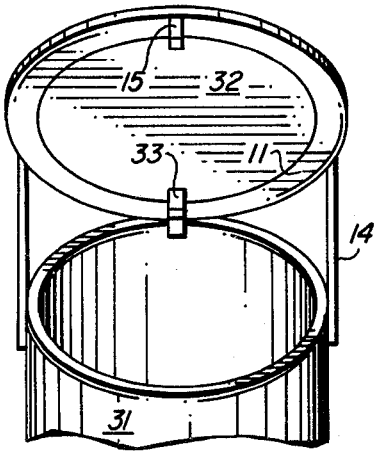
FIG. 10 is a sectional view of the top of the hopper illustrated in FIG. 9, with the tank lid open.

Referring now to FIGS. 9 and 10, it will be appreciated that the hopper 1 can be constructed with a cylindrical tank 31, having a round tank lid 32, complete with a lid gasket 11 and lid retainer 15, and attached to cylindrical tank 31 by means of a tank lid hinge 33. The hopper funnel 3 and pump support 6 are substantially the same as the counterparts on the square or rectangular hopper illustrated in FIGS. 1–5, except for the curved top segments of funnel sides 4 and pump support sides 8.

In operation, and referring again to FIG. 4 of the drawings, the hopper lid 10 is initially opened and a conventional pump 25 is inserted in pump access aperture 16, as illustrated in FIGS. 2 and 4. The conventional pump 25 is securely seated and sealed by means of pump access gasket 17 in pump access aperture 16, with a conventional pump bracket 27 positioned adjacent pump support front 7, and bracket toe 28 adjacent the supporting floor surface. A supply of wet premixed joint cement is then introduced into the hopper 1, and the hopper lid 10 is tightly closed to prevent premature drying of the cement. The tight fit of lid gasket 11 against the top of hopper 1 and pump access gasket 17 against the pump 25 serves to retard premature drying of the joint cement. The hopper 1 can now be positioned at any location on the job, and particularly, in close proximity to the drywall construction workers, to provide a source of fresh drywall joint cement of selected consistency at the desired location. Desired quantities of joint cement can be dispensed from the discharge 40 of a conventional pump 25 inserted in the hopper 1 by manipulating pump handle 26 of conventional pump 25, as desired.

It will be appreciated by those skilled in the art that the conventional pump 25 illustrated in FIG. 4 is a hand pump, the design and operation of which is well known. Electric pumps of proper design can also be used in cooperation with the hopper of this invention according to the knowledge of those skilled in the art, but it will be recognized that hand demand pumps such as conventional pump 25 are preferred for more positive control of the quantity of joint cement dispensed from hopper 1.

In another most preferred embodiment of this invention the hopper 1 illustrated in FIGS. 1–5 is about 14 inches in width, measured along each of the hopper sides 2, and stands about 40 inches high, measured from the supporting surface to hopper lid 10. Furthermore, the pump support deck 9 extends about 4 inches from the front one of hopper sides 2, and hopper 1 is designed to contain about 250 pounds of dry joint compound, plus sufficient water to provide a compound cement of desired consistency. The hopper 1 is also fabricated of sixteen gauge sheet metal according to a most preferred embodiment of the invention in order to provide sufficient strength when loaded, and should be painted, both inside and out, to resist corrosion. Alternatively, anodized aluminum can be used as a material of construction, as desired, and as deemed expedient by those skilled in the art.

Having described my invention with the particularity set forth above, what is claimed is:

1. A hopper for containing liquid joint cement comprising a supply container having an open top and a generally funnel-shaped bottom portion; and a pump support characterized by a pump support deck extending from said supply container in a slightly downward slope; a pump support front extending essentially vertically downwardly from said pump support deck and defining a frontal extremity of said pump support means; and pump support sides extending rearwardly from said pump support front and downwardly from said pump support deck to said bottom portion of said hopper and an access aperture in said pump support deck for inserting a pump into the interior of said bottom portion to pump joint cement from said hopper.

2. The hopper of claim 1 wherein said access aperture is defined by a pump access gasket and a gasket retainer secured to said pump support deck, and said supply container is essentially square in cross-section.

3. A hopper for containing a supply of liquid drywall joint cement comprising a supply container; a lid hingedly attached to the top of said supply container; a gasket and a lid retainer carried by said lid to seal said lid against the top of said supply container when said lid is closed; a generally funnel-shaped bottom portion joined to the lower end of said supply container, said bottom portion tapered to define a narrow funnel bottom; pump support means joined to said bottom portion, said pump support means including a pump support deck having a deck aperture therein and extending downwardly from said support container at a selected angle, a pump support front extending essentially vertically downwardly from said pump support deck, and pump support sides extending rearwardly from said pump support front and downwardly from said pump support deck to said bottom portion to close said bottom portion; and a gasket retainer having a retainer aperture in registration with said deck aperture, and a pump access gasket having an access aperture smaller than said deck aperture and said retainer aperture, said gasket retainer and said pump access gasket secured to said pump support deck, whereby a pump can be inserted through said retainer aperture, said access aperture and said deck aperture and into said bottom portion of said supply container to pump the joint cement from said supply container.

4. The hopper of claim 3 further comprising wheels rotatably secured to said supply container and a handle provided on said supply container to facilitate rolling of said supply container from one location to another.

5. The hopper of claim 4 wherein the cross section of said supply container is shaped in the form of a polygon.

6. The hopper of claim 4 wherein said polygon is essentially a square.

7. The hopper of claim 4 wherein said supply container is shaped essentially in the form of a cylinder.

* * * * *